United States Patent [19]

Binasik et al.

[11] 4,230,449

[45] Oct. 28, 1980

[54] SELF CONTAINED COMPACT BURNER

[75] Inventors: Chester S. Binasik, Palo Alto; Ralph R. Vosper, San Jose; Norman E. Harthun, San Carlos, all of Calif.

[73] Assignee: Coen Company, Burlingame, Calif.

[21] Appl. No.: 21,740

[22] Filed: Mar. 19, 1979

[51] Int. Cl.[3] ..... F23D 15/02

[52] U.S. Cl. ..... 431/353; 239/403; 431/285; 431/265; 431/188

[58] Field of Search ..... 431/353, 182, 183, 188, 431/265; 126/91 A

[56] References Cited

U.S. PATENT DOCUMENTS

| | | | |
|---|---|---|---|
| 2,249,482 | 7/1941 | Macchi | 431/265 |
| 2,396,875 | 3/1946 | Noack | 431/183 |
| 2,606,604 | 8/1952 | Witherell | 431/353 |
| 3,739,989 | 7/1973 | Vosper | 239/399 |
| 4,168,948 | 9/1979 | Okamoto et al. | 431/265 |

*Primary Examiner*—Carroll B. Dority, Jr.

*Attorney, Agent, or Firm*—Townsend and Townsend

[57] ABSTRACT

A low pressure burner capable of generating a relatively long narrow flame is disclosed. A rotationally symmetric chamber is open at each end. Air is forced through the chamber at low pressure, generally no greater than about 0.3 lbs. per square inch above ambient. An atomizer is located in the chamber and expels a combustible mixture out through the downstream end of the chamber. The mixture expelled by the atomizer of the present invention has a distribution which is not rotationally symmetric about the chamber axis. The atomizer utilizes low pressure air provided at no greater than about 4.5 lbs. per square inch above ambient. A flame throat is located at the downstream end of the chamber, and includes at least two axially spaced steps to induce and control eddy formation in the mixture. The nonsymmetric mixture distribution and the multistep chamber combine to provide a long, narrow, stable flame in the throat at relatively low inlet air pressures.

7 Claims, 4 Drawing Figures

SELF CONTAINED COMPACT BURNER

BACKGROUND OF THE INVENTION

The present invention relates to burners capable of utilizing relatively low pressure air sources and still provide a long, narrow flame.

Burners are used in many applications in which a long, narrow flame is desirable. For example, unwanted water is often removed from crude oil in the field by placing the crude oil in a large vat, and heating the oil by projecting a flame into a tube in the bottom of the vat to vaporize the water. A relatively long flame is desirable to distribute heat throughout the tube. Ofter crude oil itself is used in the combustible mixture, and excess crude oil must not splash on the walls of the tube because it would cause an unwanted build up of carbon deposits. Accordingly, the flame should not only be long but must be quite narrow as well.

The typical solution in applications requiring a long, narrow flame such as that described above is to utilize a burner in which high pressure air is used to feed combustion (primary air) and to atomize the combustible material (atomizing air). Such high pressure air both increases the length of the flame and decreases its width. However, the provision of air at high pressures requires large capacity blowers, both for primary air and atomizing air. As a result, large side draft fans are typically used which are expensive, noisy and require frequent maintenance, a particular problem in many field applications.

It would be desirable to provide a burner which generates a long, narrow flame, but operates off of relatively low pressure air sources. Such a system could use a simply centrifugal fan for its primary air supply, and a smaller side draft fan for atomizing air. Such fans would be less noisy, and would have a much lower maintenance requirement. However, in the past, it has been found difficult to generate a long, narrow flame using such low pressure air supplies. Moreover, attempts to lengthen the flame provided by such a burner have generally resulted in unstable flames, which may extinguish themselves, or unwanted vibrations resulting from cyclic variations in the flame front, often called a "diaphragm" effect.

SUMMARY OF THE INVENTION

The present invention provides a low pressure burner capable of generating a relatively long, narrow flame. A rotationally symmetric chamber is open at each end. Air is forced through the chamber at low pressure, generally no greater than about 0.3 lbs. per square inch above ambient. An atomizer is located in the chamber and expels a combustible mixture out through the downstream end of the chamber. The mixture expelled by the atomizer of the present invention has a distribution which is not rotationally symmetric about the chamber axis. The atomizer utilizes low pressure air provided at no greater than about 4.5 lbs. per square inch above ambient. A throat is located at the downstream end of the chamber, and includes at least two axially spaced steps to induce and control eddy formation in the mixture.

The unsymmetric distribution and eddy control act in combination to eliminate the "diaphragm" effect and resultant vibration which has plagued low pressure burners in the past. In addition, the present invention provides a flame which is stable and not susceptible to being accidentally extinguished. The flame provided by the burner of the present invention is relatively long and narrow, greatly facilitating the substitution of a low pressure burner for high pressure burners in a wide variety of applications.

In the past, it has been found desirable to provide the atomizing air into two streams. One stream is directly mixed with the combustible substance within the atomizer, and a second stream provides a circumferential cushion for the combustible mixture at the outlet of the atomizer. An atomizer of this type is illustrated in U.S. Pat. No. 3,739,989, assigned to the assignee of the instant case. However, such prior art atomizers have employed a circumferential passage for the second air stream which undergoes two 90° changes in direction as it is fed into the combustible mixture. In a preferred embodiment of the present invention, a passage is provided for such secondary air which is inclined at an oblique angle relative to the center line of the atomizer to minimize the pressure drop of this airstream, and facilitate the use of the second air stream in providing a cushion surrounding the combustible mixture. This is a particular advantage of the context of the present invention in which relatively low pressure atomizing air is used, and the pressure drop of the air supply must be kept to a minimum.

The novel features which are characteristic of the invention, as to organization and method of operation, together with further objects and advantages thereof will be better understood from the following description considered in connection with the accompanied drawings which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
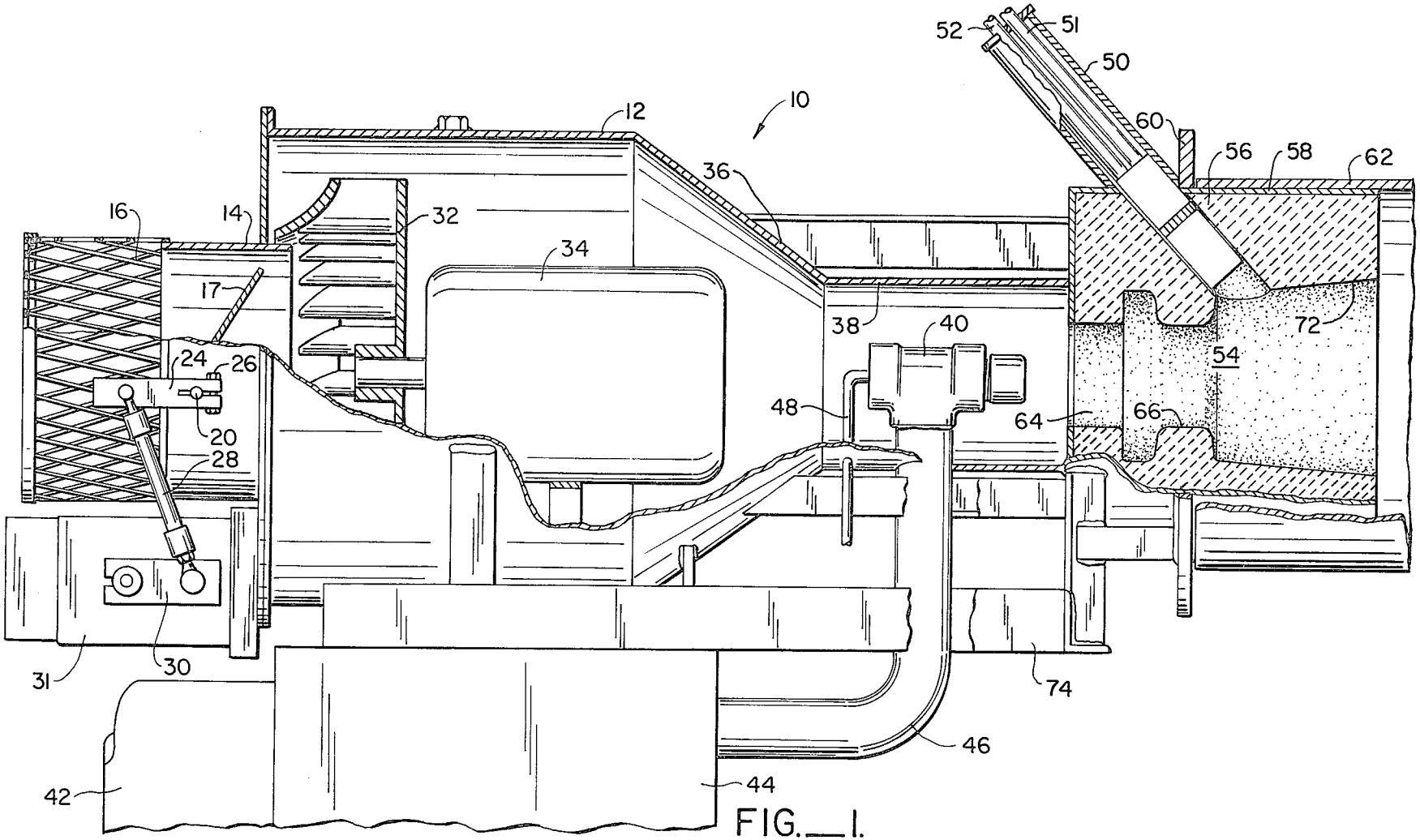
FIG. 1 is a side elevation view of a preferred embodiment of the burner of the present invention with portions cut away to permit viewing of the interior of the burner.
Figure 2:
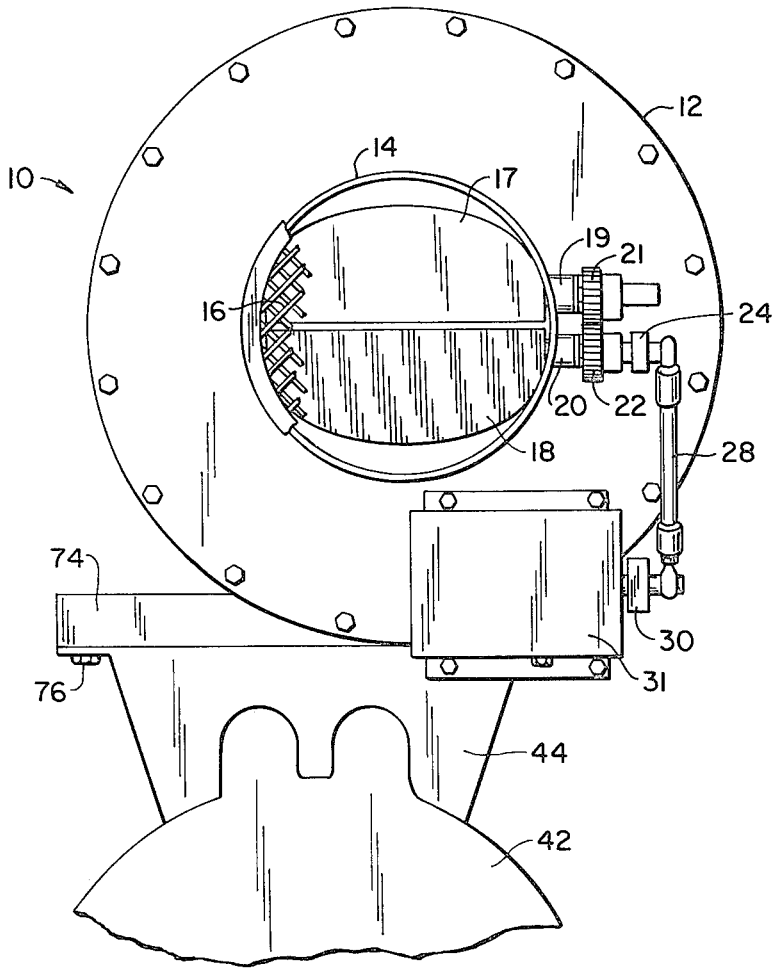
FIG. 2 is a rear elevation view of the burner illustrated in FIG. 1.

The preferred embodiment 10 of the burner of the present invention is illustrated generally by way of reference to FIGS. 1 and 2. Burner 10 includes a rotationally symmetric chamber 12 having openings at either end.

A throttling chamber 14 is located at the upstream end of chamber 12. Throttling chamber 14 includes a screen 16 to filter incoming air to be used for combustion, designated as "primary air" herein. A matched pair of throttle plates 17, 18 is located in throttling chamber 14. Throttling plates 17, 18 are mounted on shafts 19, 20 which are interconnected by spur gears 21, 22 so that the shafts rotate in unison. A lever arm 24 is fastened to shaft 20 by bolt 26. A connecting rod 28 interconnects lever 24 with an output lever 30 from actuator 31 to provide a throttle control for air entering chamber 12.

A centrifugal fan 32 is located within the upstream end of chamber 12 and is powered by motor 34. Centifugal fan 32 draws the primary air within chamber 12, and forces the primary air through the chamber at relatively low pressure, generally no greater than about 0.3 pounds per square inch above ambient. An overpressure of about 0.14 pounds per square inch has been found to be sufficient. The primary advantages of centrifugal fan 32 over more conventional side draft fans are its low maintenance and low noise level.

Chamber 12 includes a tapered portion 36 and a relatively narrow neck 38. An atomizer 40 is located in the center of the narrow neck 38 of the chamber 12 to provide a combustible mixture.

A regenerative blower 42 provides atomizing air through a muffler 44 and conduit 46 to atomizer 40. A combustible substance such as crude oil, diesel oil or the like is fed to atomizer 40 via tube 48. As will be discussed in more detail hereinafter, atomizer 40 creates a mixture consisting of the atomizing air through conduit 46 and the combustible substance entering through tube 48. The mixture is projected out of the downstream end of the chamber 12 along the axis of the chamber.

Blower 42 provides atomizing air at relatively low pressure, generally no greater than about 4.5 pounds per square inch above ambient. A blower providing atomizing air at about 2.5 pounds per square inch has been found to be sufficient.

An igniter 50 which includes one or more supply tubes 51, 52 projects into the narrow neck of chamber 12 downstream of atomizer 40 to ignite the mixture and initiate combustion. Once combustion is initiated, it is self sustaining until the supply of the combustible substance through tube 48 is discontinued.

A flame throat 54 is located at the downstream end of chamber 12. Flame throat 54 is defined by a refractory element 56 located within a metallic housing 58. An abuttment 60 is welded to the outer circumference of housing 58 to limit insertion of the housing within a conduit 62 into which a flame is to be projected.

Refractory element 56 is contoured so that at least two steps 64, 66 are provided at the first stage of the throat. The steps induce eddies in the mixture and the primary air which facilitate mixing of the mixture with the primary air at selected positions spaced along the length of throat 54 to provide a diluted mixture which is combustible. Flame throat 54 terminates in an expansion cone 72.

A flame 74 is welded to the underside of chamber 12. Blower 42 is fastened to frame 74 by bolts 76 which attach muffler 44 to frame 74. Burner 10 is entirely self contained except for the peripherally mounted blower 42 for atomizing air and its muffler 44.

Figure 4:
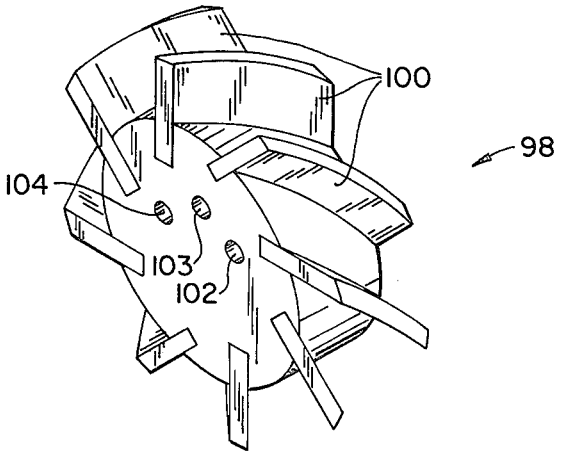
FIG. 4 is a perspective view of the swirl plate used in the preferred embodiment of the atomizer of the present invention.
Figure 3:
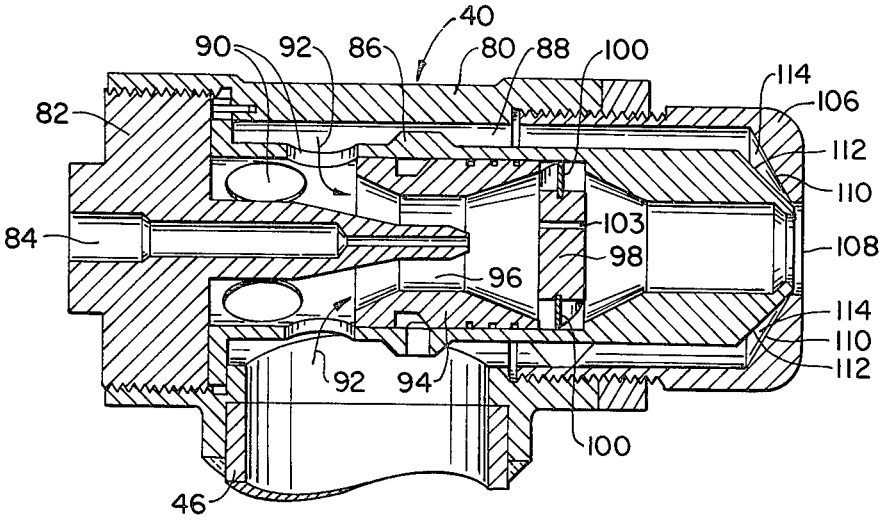
FIG. 3 is a side sectional view of the preferred embodiment of the atomizer of the present invention.

The preferred embodiment of atomizer 40 is illustrated by way of reference to FIGS. 3 and 4. Atomizer 40 includes a T fitting 80 which attaches to the top of the conduit 46 for atomizing air. A plug 82 is threadably engaged with the upstream end of T fitting 80, and includes a central passage 84 for the entry of a combustible material.

Atomizer 40 includes a central core 86 which is spaced from the interior walls of T fitting 80 to provide an annular passage 88. A plurality of apertures 90 are provided in the upstream end of core 86 to allow atomizing air to pass from annular passage 88 to the interior of the core, as depicted by arrows 92. A hollow insert 94 is located inside core 86 to provide an interior venturi section 96. The combustible material is mixed with the atomizing air in verturi section 96.

To facilitate intermixing of the combustible material with the atomizing air, a swirl plate 98, depicted in detail in FIG. 4, is located within core 86. Swirl plate 98 is provided with a plurality of circumferentially disposed vanes 100 which impart a swirling motion to the mixture.

Swirl plate 98 of the present invention also includes a plurality of apertures 102–104 which are parallel to the centerline of the atomizer 40. In the preferred embodiment of the present invention, apertures 102–104 are each located the same radial distance from the axis of atomizer 40, and the two side apertures 102 and 104 are located at a 60° angle from central aperture 103 relative to the axis of the atomizer. A portion of the mixture passes around swirl plate 98 through vanes 100, while the remainder passes through off-center apertures 102–104. In this fashion, the mixture passing through chamber 96 downstream of swirl plate 90 has a distribution which is not rotationally symmetric about the chamber axis.

A nozzle plug 106 is threadably engaged with the upstream end of T fitting 80. Nozzle plug 106 includes a central aperture 108, and a tapered interior surface 110 terminating at aperture 108. The downstream end of core 86 is provided with corresponding inwardly tapered surface 112 which acts in combination with surface 110 to provide an inwardly directed tapered passageway 114 communicating with annular passage 88. As a result, atomizing air not only enters chamber 96 through apertures 90, but a secondary supply of atomizing air is provided through inclined passageway 114. This secondary supply of atomizing air provides a "cushion" of air at the tip of the atomizer, and minimizes fouling of the atomizer tip with the combustible substance.

In operation, fan 32 provides a continuous flow of primary air through chamber 12. The volume of flow of primary air is controlled by throttle plates 17, 18. The mixture is injected into the stream of primary air along the centerline of chamber 12 in its narrow neck 38. The distribution of the mixture is not rotationally symmetric about the axis of the chamber because of the construction of the swirl plate of the present invention as discussed above.

The mixture begins burning within flame throat 54. The steps 64, 66 induce a sequence of longitudinally spaced eddies which enhance mixing of the mixture with the primary air to obtain complete combustion. Because of the nonsymmetric distribution of the mixture provided by atomizer 40, a long, narrow flame is provided which is not subject to stability and vibration problems.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A low pressure burner capable of generating a relatively long, narrow flame comprising:

a generally rotationally symmetric chamber having an opening at its upstream and an opening at its downstream end;

means for forcing air through the chamber from its upstream end to its downstream end at a pressure no greater than about 0.3 pounds per square inch above ambient pressure;

an atomizer located in said chamber downstream of the air forcing means and adapted to expel a mixture out through the downstream end of the chamber along the chamber axis so that the distribution of the mixture is not rotationally symmetric about the chamber axis;

means for supplying atomizing air to the atomizer at a pressure no greater than about 4.5 pounds per square inch above ambient pressure; and a flame throat projecting from the downstream end of the chamber, said throat including at least two axially spaced steps to induce and control the location of eddy formation in the mixture.

2. A burner as recited in claim 1 wherein said air forcing means comprises a centrifugal fan located within the chamber.

3. A burner as recited in claim 1 wherein said atomizer includes a swirl plate located within the atomizer and having a plurality of circumferentially spaced, inclined blades in the path of the mixture adapted to impart rotational motion to the mixture about the axis of the chamber, and at least one aperture through the swirl plate parallel to the chamber axis nonsymmetrically disposed relative to the chamber axis to provide a distribution of the mixture which is not rotatationally symmetric.

4. A low pressure burner capable of generating a relatively long, narrow flame comprising:

a generally rotationally symmetric chamber having an opening at its upstream end and an opening at its downstream end;

a centrifugal fan adapted to force air through the chamber from its upstream end to its downstream end at a pressure no greater than about 0.3 pounds per square inch above ambient pressure;

an atomizer located in said chamber downstream of the centrifugal fan and adapted to expel a mixture out through the downstream end of the chamber along the chamber axis, said atomizer including a swirl plate located within the atomizer in the path of the mixture and having a plurality of circumferentially spaced, inclined blades adapted to impart rotational motion to the mixture about the axis of the chamber, and at least one aperture through the swirl plate parallel to the chamber axis and nonsymmetrically disposed relative to the chamber axis to provide a distribution of the mixture which is not rotationally symmetric;

means for supplying atomizing air to the atomizer at a pressure no greater than about 4.5 pounds per square inch above ambient pressure; and a flame throat projecting from the downstream end of the chamber, said throat including at least two axially spaced steps to induce and control the location of eddy formation.

5. A burner as recited in claim 1 or 4 wherein said atomizer includes means for injecting a circumferential cushion of air circumscribing the mixture at the outlet end of said atomizer, said injecting means including means for injecting the air at an oblique angle relative to the chamber axis to minimize the pressure drop of said injected air.

6. A low pressure burner capable of generating a relatively long, narrow flame comprising:

a generally rotationally symmetric chamber having an opening at its upstream end and an opening at its downstream end;

a centrifugal fan located within the chamber to force air through the chamber from its upstream end to its downstream end at a pressure no greater than about 0.3 pounds per square inch above ambient pressure;

an atomizer located within said chamber downstream of the centrifugal fan and adapted to expel a mixture out through the downstream end of the chamber along the chamber axis, said atomizer including a swirl plate located within the atomizer in the path of the mixture and having a plurality of circumferentially spaced, inclined blades adapted to impart rotational motion to the mixture about the axis of the chamber, and at least one aperture through the swirl plate parallel to the chamber axis of nonsymmetrically disposed relative to the chamber axis to provide a distribution of the mixture which is not rotationally symmetric, said atomizer further including means for injecting a circumferential cushion of air circumscribing the mixture at the outlet end of said atomizer, said injecting means including means for injecting the air at an oblique angle relative to the chamber axis to minimize the pressure drop of said injected air;

means for supplying atomizing air to the atomizer at a pressure no greater than about 4.5 pounds per square inch above ambient pressure; and a flame throat projecting from the downstream end of the chamber, said throat including at least two axially spaced steps to induce and control the location of eddy formation.

7. A burner as recited in claim 4 or 6 wherein said swirl plate includes three apertures through the plate parallel to the chamber axis and located at equal radial distances from the chamber axis, said apertures including a central aperture and two side apertures located at an included angle of 60° from the central aperture relative to the chamber axis to provide a distribution of the mixture which is not rotationally symmetric.

* * * * *